US007762395B2

(12) United States Patent
Sutherland et al.

(10) Patent No.: US 7,762,395 B2
(45) Date of Patent: Jul. 27, 2010

(54) CARRIER PACKAGES AND METHODS OF ERECTING CARRIER PACKAGES

(75) Inventors: Robert L. Sutherland, Kennesaw, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 366 days.

(21) Appl. No.: 11/736,184

(22) Filed: Apr. 17, 2007

(65) Prior Publication Data

US 2007/0241017 A1 Oct. 18, 2007

Related U.S. Application Data

(60) Provisional application No. 60/792,541, filed on Apr. 17, 2006.

(51) Int. Cl.
*B65D 75/00* (2006.01)

(52) U.S. Cl. ..... 206/427; 206/147; 206/434

(58) Field of Classification Search ..... 206/139–141, 206/145–147, 149–153, 158, 160, 161, 427, 206/428, 434, 435
See application file for complete search history.

(56) References Cited

U.S. PATENT DOCUMENTS

| | | | | |
|---|---|---|---|---|
| 2,849,111 | A | 8/1958 | Fielding | |
| 2,928,541 | A | 3/1960 | Fielding | |
| 3,178,242 | A | 4/1965 | Ellis | |
| 3,300,115 | A | 1/1967 | Schauer | |
| 3,306,519 | A | 2/1967 | Wood | |
| 3,339,723 | A | 9/1967 | Wood | |
| 3,356,279 | A | 12/1967 | Root | |
| 3,373,867 | A | 3/1968 | Wood | |
| 3,593,849 | A | 7/1971 | Helms | |
| 3,635,452 | A | 1/1972 | Helms | |
| 3,669,342 | A | 6/1972 | Funkhouser | |
| 3,747,835 | A | 7/1973 | Graser | |
| 3,767,042 | A | 10/1973 | Ganz | |
| 3,963,121 | A | 6/1976 | Kipp | |
| 4,010,593 | A | 3/1977 | Graham | |
| 4,101,069 | A | 7/1978 | Wood | |
| 4,202,446 | A | 5/1980 | Sutherland | |
| 4,328,893 | A | 5/1982 | Oliff et al. | |
| 4,394,903 | A * | 7/1983 | Bakx | 206/427 |
| 4,424,901 | A | 1/1984 | Lanier | |
| 4,440,340 | A | 4/1984 | Bakx | |
| 4,566,593 | A | 1/1986 | Muller | |
| 4,747,487 | A | 5/1988 | Wood | |
| 4,875,585 | A | 10/1989 | Kadleck et al. | |
| 4,966,324 | A | 10/1990 | Steel | |
| 4,972,991 | A | 11/1990 | Schuster | |

(Continued)

FOREIGN PATENT DOCUMENTS

| | | |
|---|---|---|
| BE | 671.762 | 3/1996 |

(Continued)

*Primary Examiner*—J. Gregory Pickett
*Assistant Examiner*—Andrew Perreault
(74) *Attorney, Agent, or Firm*—Womble Carlyle Sandridge & Rice, PLLC

(57) ABSTRACT

Carrier packages are constructed to tightly secure articles within the packages. The carrier packages include end webs that partially close the ends of the packages and retain articles within the carrier package.

39 Claims, 8 Drawing Sheets

U.S. PATENT DOCUMENTS

| | | | | |
|---|---|---|---|---|
| 5,000,313 | A * | 3/1991 | Oliff | 206/427 |
| 5,042,660 | A | 8/1991 | Carver | |
| 5,060,792 | A | 10/1991 | Oliff | |
| 5,131,588 | A | 7/1992 | Oliff | |
| 5,180,100 | A | 1/1993 | Shimizu | |
| 5,195,676 | A | 3/1993 | LeBras | |
| 5,246,112 | A | 9/1993 | Stout et al. | |
| 5,297,673 | A | 3/1994 | Sutherland | |
| 5,351,878 | A | 10/1994 | Cooper | |
| 5,472,090 | A | 12/1995 | Sutherland | |
| 5,472,138 | A | 12/1995 | Ingram | |
| 5,505,372 | A | 4/1996 | Edson et al. | |
| 5,542,536 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,597,071 | A | 1/1997 | Sutherland | |
| 5,609,251 | A | 3/1997 | Harris | |
| 5,664,401 | A | 9/1997 | Portrait et al. | |
| 5,682,995 | A | 11/1997 | Sutherland | |
| 5,692,614 | A | 12/1997 | Harris | |
| 5,778,630 | A | 7/1998 | Portrait et al. | |
| 5,853,088 | A | 12/1998 | Saulas et al. | |
| 5,855,318 | A | 1/1999 | Baxter | |
| 5,931,300 | A | 8/1999 | Sutherland | |
| 5,937,620 | A | 8/1999 | Chalendar | |
| 5,941,453 | A | 8/1999 | Oliff | |
| 5,943,847 | A | 8/1999 | Chalendar | |
| 5,947,367 | A | 9/1999 | Miller et al. | |
| 5,975,286 | A | 11/1999 | Oliff | |
| 6,019,220 | A | 2/2000 | Sutherland | |
| 6,021,898 | A | 2/2000 | Sutherland | |
| 6,021,899 | A | 2/2000 | Sutherland | |
| 6,109,438 | A | 8/2000 | Sutherland | |
| 6,155,480 | A | 12/2000 | Botsford et al. | |
| 6,158,586 | A | 12/2000 | Muller | |
| 6,289,651 | B1 | 9/2001 | Le Bras | |
| 6,315,123 | B1 | 11/2001 | Ikeda | |
| 6,550,616 | B2 | 4/2003 | Le Bras | |
| 6,811,525 | B2 | 11/2004 | Culpepper | |
| 6,866,185 | B2 | 3/2005 | Harrelson | |
| 6,948,651 | B2 | 9/2005 | Ikeda | |
| 6,981,631 | B2 | 1/2006 | Fogle et al. | |
| 6,988,617 | B2 * | 1/2006 | Gomes et al. | 206/434 |
| 7,007,800 | B2 * | 3/2006 | Le Bras | 206/427 |
| 7,159,759 | B2 | 1/2007 | Sutherland | |
| 7,448,492 | B2 * | 11/2008 | Sutherland | 206/427 |
| 2003/0000182 | A1 | 1/2003 | Portrait et al. | |
| 2003/0132130 | A1 | 7/2003 | Le Bras | |
| 2004/0089671 | A1 | 5/2004 | Miller | |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Gamier | |
| 2005/0178791 | A1 | 8/2005 | Miller | |
| 2005/0194430 | A1 | 9/2005 | Auclair et al. | |
| 2006/0191811 | A1 | 8/2006 | Fogle et al. | |

FOREIGN PATENT DOCUMENTS

| | | | |
|---|---|---|---|
| DE | 91 04 905.9 | | 6/1991 |
| DE | 92 03 858.1 | | 5/1992 |
| EP | 0 459 658 | A1 | 12/1991 |
| EP | 0 509 749 | A1 | 10/1992 |
| EP | 0520 411 | A1 | 12/1992 |
| FR | 2 698 074 | | 5/1994 |
| WO | WO 97/27124 | | 7/1997 |
| WO | WO 02/102208 | A1 | 12/2002 |
| WO | WO 03/008292 | A2 | 1/2003 |
| WO | WO 2005/042370 | A1 | 12/2005 |

* cited by examiner

CARRIER PACKAGES AND METHODS OF ERECTING CARRIER PACKAGES

PRIORITY APPLICATION

This application claims the benefit of U.S. Provisional Application No. 60/792,541, filed Apr. 17, 2006, the entire contents of which are hereby incorporated by reference.

BACKGROUND

Carrier packages are typically formed by wrapping a carrier blank around a group of containers and securing the ends of the blank together. The containers are held in place by the wrapped carrier. In conventional carrier packages, however, the package may not be sufficiently tightly wrapped, causing the wrapped package to have low structural rigidity and possibly resulting in containers falling out of the wrapped package.

SUMMARY

According to an aspect of the invention, a carrier package comprises a plurality of articles accommodated within a carrier constructed from a carrier blank. The carrier blank comprises a bottom panel, a first side panel, a second side panel, a top panel, a first end web and a second end web. The first and second end webs at least partially close the ends of the carrier package and prevent the articles from falling out of the carton ends.

According to another exemplary aspect of the invention, top webs and bottom end panels foldably connected to the bottom panel can further partially close the ends of the carrier package. The end webs, top webs and bottom end panels can be arranged in a carrier blank such that the end webs tuck in toward and secure the articles as the carrier is erected.

According to yet another exemplary aspect of the invention, the carrier package may include retaining projections formed at least partially from the side panels. The retaining projections may engage recesses in the articles and help retain the articles within the carrier package.

Those skilled in the art will appreciate the above stated advantages and other advantages and benefits of various additional embodiments after reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
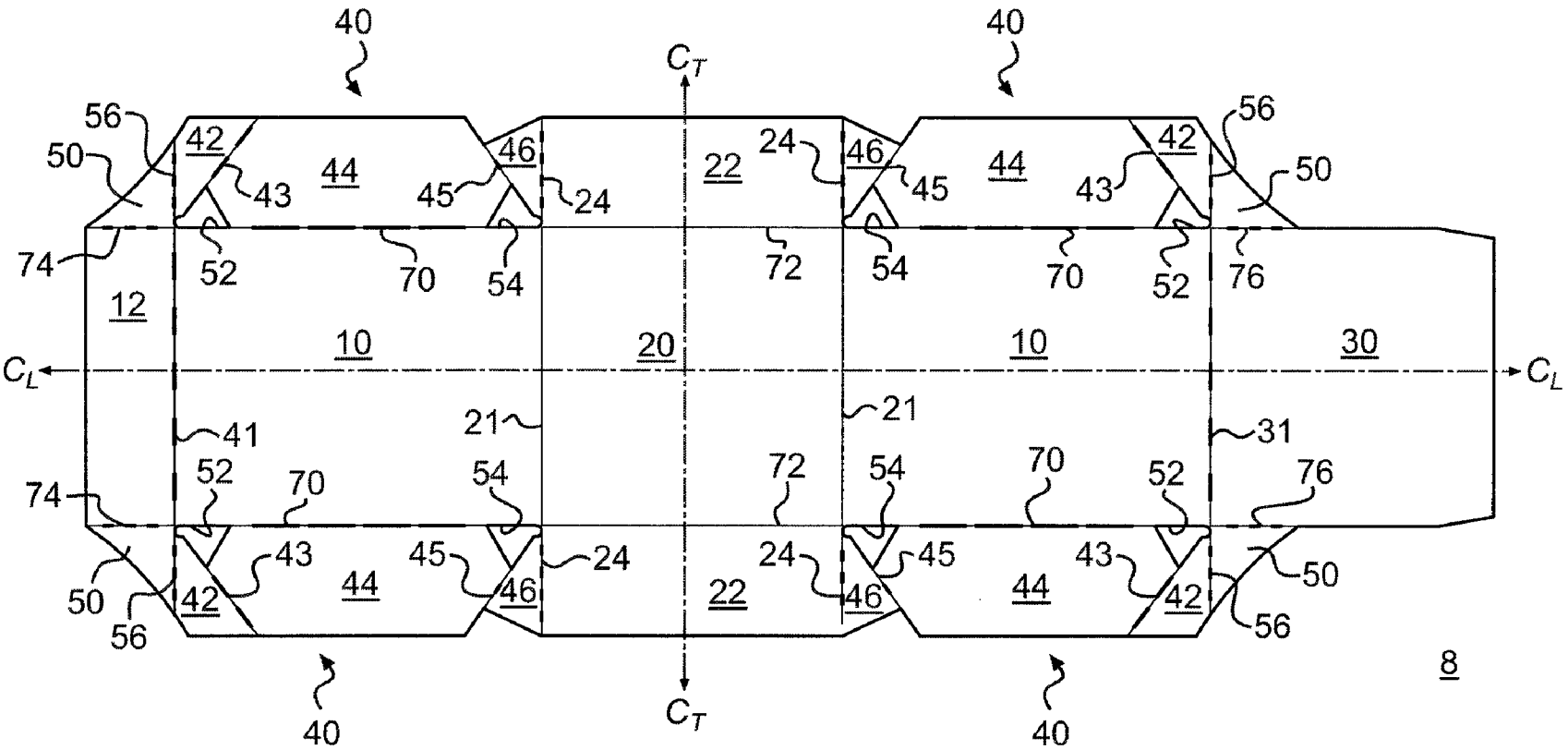
FIG. 1 is a plan view of a carrier blank used to form a carrier package according to a first embodiment of the invention.

FIG. 1 is a plan view of a first side of a carrier blank 8 used to form a carrier package or pack 150 (illustrated in FIG. 2) according to a first embodiment of the invention. In FIG. 1, the blank 8 is shown print or exterior side up. As shown in FIG. 1, the carrier blank 8 may be wholly or partially symmetric about a longitudinal centerline $C_L$, and partially symmetric about a transverse centerline $C_T$. Therefore, certain elements in the drawing figures share common reference numerals in order to reflect the whole and/or partial longitudinal and transverse symmetries. In this specification, the terms "lower," "bottom," "side," "upper," "end" and "top" are used to indicate orientations determined in relation to fully erected carrier packages placed in upright configurations.

For the purposes of illustration and not for the purpose of limiting the scope of the invention, the following detailed description describes generally cylindrical 12 ounce beverage container cans as articles disposed within the exemplary carrier embodiments. Other types of containers not illustrated, and other articles, for example, may be accommodated in carrier packages constructed, loaded and erected according to the principles of the present invention.

Referring to FIG. 1, the carrier blank 8 comprises a first side panel 10 foldably connected to a first side of a bottom panel 20 at a transverse fold line 21, a second side panel 10 foldably connected to a second side of the bottom panel 20 at a transverse fold line 21, and a top panel 30 foldably connected to the second side panel 10 at a transverse fold line 31. An adhesive panel 12 may be foldably connected to the first side panel 10 at a transverse fold line 41. Alternatively, an adhesive panel (not illustrated) may be connected to the top panel 30 at the opposite end of the blank 8.

According to one exemplary aspect of the present invention, end webs 40, top webs 50, and bottom end panels 22 serve to at least partially close the ends of the carrier package 150 (FIG. 2) and/or retain containers C or other articles within the carrier package. A bottom end panel 22 may be foldably connected to each end of the bottom panel 20 at a longitudinally extending fold line 72. An end web 40 may be foldably connected to each end of each of the side panels 10 at a longitudinal fold line 70.

Each end web 40 comprises an upper end web panel 42, a major end web panel 44 foldably connected to an upper end web panel 42 at an oblique fold line 43, and a lower end web panel 46 foldably connected to a major end web panel 44 at an oblique fold line 45. Each lower end web panel 46 is foldably connected to one side of a bottom end panel 22 at a transverse fold line 24.

A top web 50 is disposed generally at each corner of the blank 8. On one side of the blank 8, top webs 50 are foldably connected to opposite ends of the adhesive panel 12 at longitudinal fold lines 74 and to upper end web panels 42 at transverse fold lines 56. On the other side of the blank 8, top webs 50 are foldably connected to opposite ends of the top panel 30 at longitudinal fold lines 76 and to upper end web panels 42 at transverse fold lines 56. Upper cutout apertures 52 may be struck from each end web 40 at a junction of a side panel 10, a major end web panel 44, and an upper end web panel 42. Lower cutout apertures 54 may be struck from each end web 40 at a junction of a side panel 10, a major end web panel 44, and a lower end web panel 46.

The fold lines 21, 31, 41, 43, 45, 24, 56, 70, 72, 74, 76 formed in the blank 8 may be, for example, score lines, cut-space lines, cut-crease lines, overlapping and/or sequential combinations thereof, or other lines of disruption that facilitate folding, bending and/or erection of the blank 8. In the illustrated exemplary embodiment, the fold lines 21, 72 are crease lines and the fold lines 31, 41, 43, 45, 24, 56, 70, 74, 76 are cut-crease lines.

Figure 2:
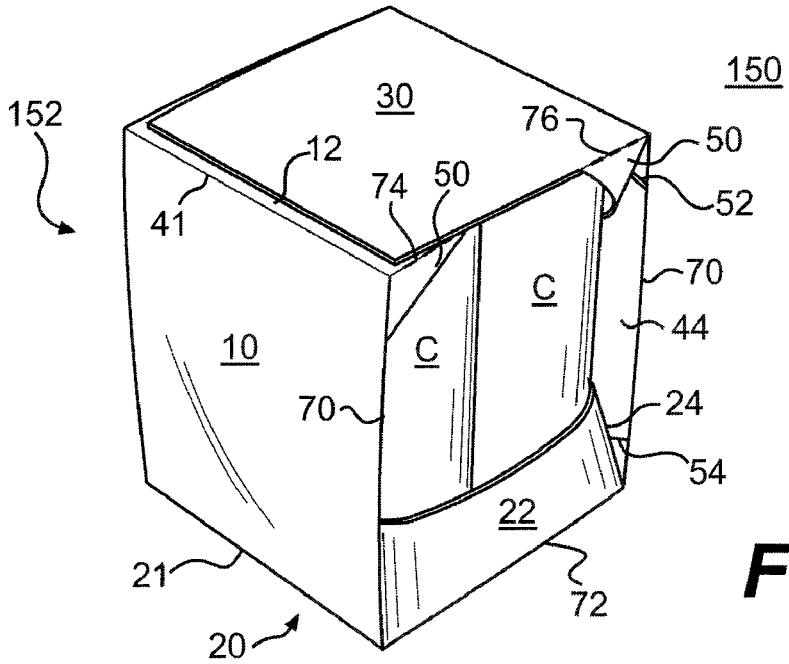
FIG. 2 illustrates the carrier package according to the first embodiment of the invention.

An exemplary method of erection of the carrier package 150 is discussed below with reference to FIGS. 1 and 2. In the exemplary method, the carrier blank 8 may be provided with glue or other adhesive on the print or exterior side of the adhesive panel 12. An n×m arrangement of containers C, where n and m are positive integers, is placed on the bottom panel 20. The side panels 10 of the blank 8 are folded upwardly about the transverse fold lines 21. The webs 40, 50 are folded inwardly as the side panels 10 are folded upwardly. The major end web panels 44 of the webs 40 fold or tuck inwardly about the longitudinal fold lines 70 so that they abut the sides of the containers C, as shown in FIG. 2. The lower end panels 46 fold with respect to the major end panels 44 at the fold lines 45, and with respect to the bottom end panels 22 at the fold lines 24. The lower end panels 46 are tucked between an adjacent container C and adjacent panels 10 and 44, and are not visible in FIG. 2. Similarly, the upper end panels 42 fold with respect to the major end panels 44 at the fold lines 43, and with respect to the top web panels 50 at the fold lines 56. The upper end panels 42 are tucked between an adjacent container C and adjacent panels 10 and 44, and are not visible in FIG. 2. As the side panels 10 are folded upwardly, the bottom end panels 22 fold upwardly with respect to the bottom panel 20, and partially wrap and deform around the exteriors of the containers C at each end of the blank.

When the first and second side panels 10 reach a generally vertical orientation, the adhesive panel 12 is folded inwardly about the fold line 41, and the top panel 30 is folded about the fold line 31 so that the underside of the top panel 30 contacts the adhesive on the adhesive panel 12. As shown in FIG. 2, the upper surface of the adhesive panel 12 is adhered to the underside of the top panel 30 to complete erection of the carrier package 150. In an alternative embodiment, the adhesive panel 12 can be folded over and adhered to the upper surface of the top panel 30. The erected blank 8 forms a carrier 152 accommodating the n×m arrangement of containers C.

Figure 3:
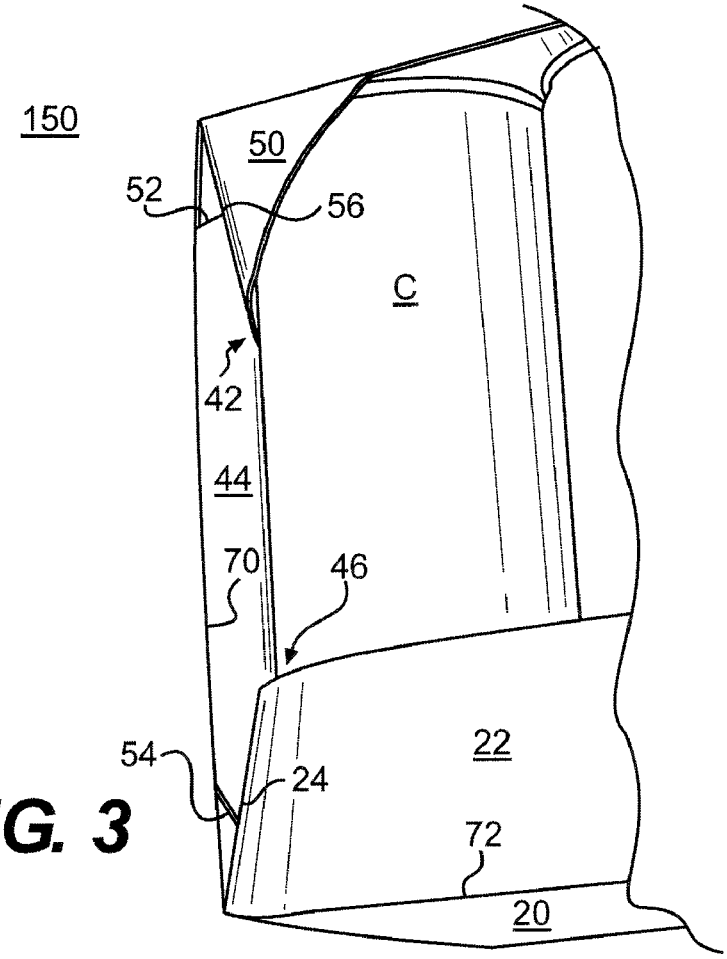
FIG. 3 is a partial isolated view illustrating an end of the first carrier package embodiment.

Referring to FIG. 2, the containers C are retained at the sides of the carrier package 150 by the side panels 10 and at their tops by the top panel 30. The end webs 40, the top webs 50, and the bottom end panels 22 serve to partially close each of the ends of the carrier package 150 and/or retain the containers C within the carrier package 150. The carrier package 150 can have, for example, a generally parallelepipedal shape. Referring to FIG. 3, the bottom end panels 22 abut and retain bottom portions of the containers C within the carrier package 150. The top webs 50 extend obliquely across the open ends of the carrier package 150 and retain upper portions of the containers C within the carrier package 150. The upper end web panels 42, the major end web panels 44, and the lower end web panels 46 are tucked inwardly and press against the sides of the containers C. The major end web panels 44 are tucked inwardly so that the exterior, print sides of the web panels 44 face inwardly towards the containers C in the package 150.

The bottom end panels 22, the top webs 50 and the upper end panels 42 partially deform and wrap around the exterior surfaces of the containers C to better secure the containers within the carrier package 150. The ends of the carrier package 150 can, for example, be partially open and constructed to expose a predetermined portion of the containers C.

Figure 4:
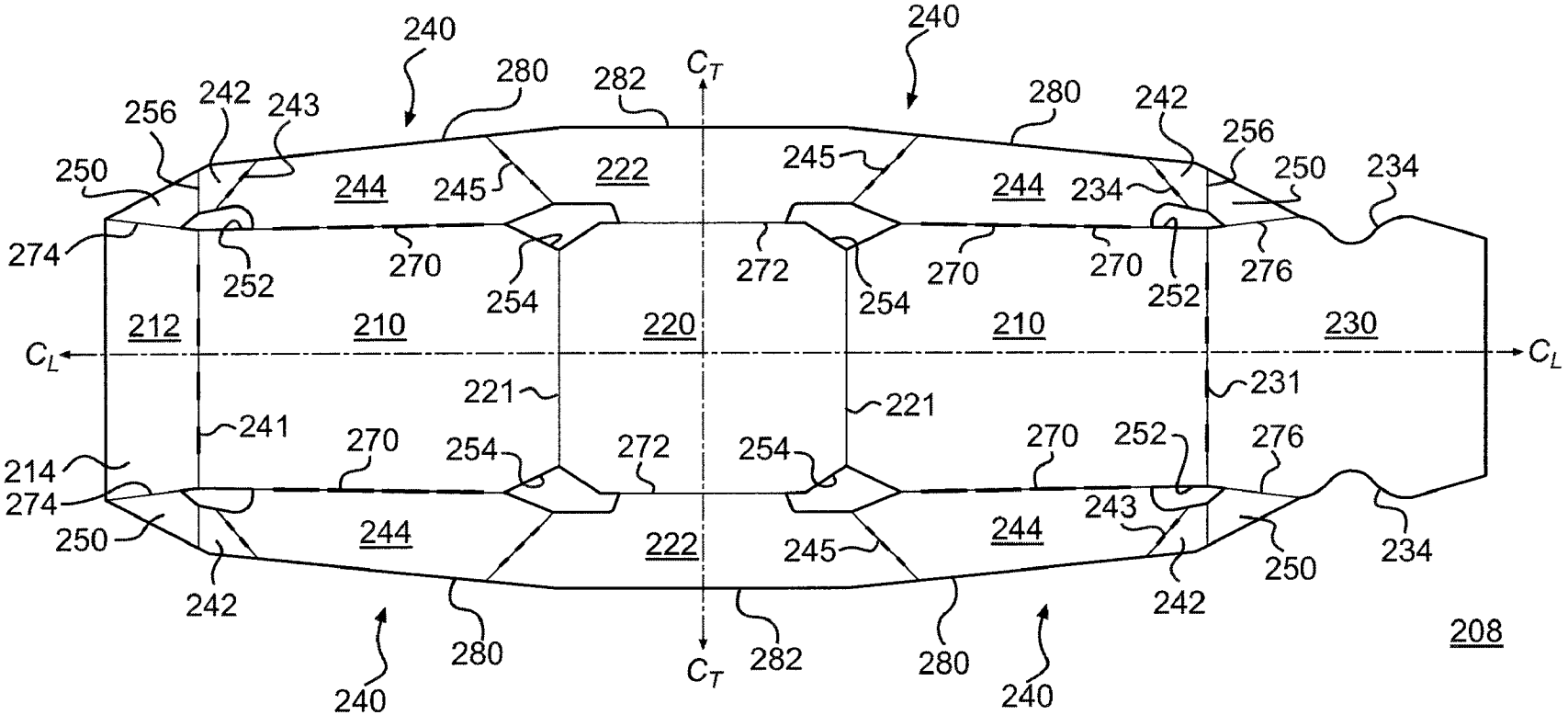
FIG. 4 is a plan view of a carrier blank used to form a carrier package according to a second embodiment of the invention.

FIG. 4 is a plan view of a first side of a carrier blank 208 used to form a carrier package or pack 350 (illustrated in FIG. 5) according to a second embodiment of the invention. In FIG. 4, the blank 208 is shown print or exterior side up. The carrier blank 208 may be wholly or partially symmetric about a longitudinal centerline $C_L$, and partially symmetric about a transverse centerline $C_T$. Therefore, certain elements in the drawing figures share common reference numerals in order to reflect the whole and/or partial longitudinal and transverse symmetries.

The blank 208 comprises a first side panel 210 foldably connected to a first side of a bottom panel 220 at a transverse fold line 221, a second side panel 210 foldably connected to a second side of the bottom panel 220 at a transverse fold line 221, and a top panel 230 foldably connected to the second side panel 210 at a transverse fold line 231. An adhesive panel 212 may be foldably connected to the first side panel 210 at a transverse fold line 241. Alternatively, an adhesive panel (not illustrated) may be connected to the top panel 230 at the opposite end of the blank 208.

According to one exemplary aspect of the present invention, end webs 240, top webs 250, and bottom end panels 222 serve to partially close the ends of the carrier package 350 (FIG. 5) to retain containers C within the carrier package 350. A bottom end panel 222 may be foldably connected to each end of the bottom panel 220 at a longitudinally extending fold line 272. An end web 240 may be foldably connected to each end of the side panels 210 at an oblique fold line 270. Each end web 240 comprises an upper end web panel 242 and a major end web panel 244 foldably connected to the upper end web panel 242 at an oblique fold line 243 and foldably connected to one side of a bottom end panel 222 at an oblique fold line 245.

A top web 250 is disposed generally at each corner of the blank 208. On one side of the blank 208, top webs 250 are foldably connected to opposite ends of the adhesive panel 212 at longitudinal fold lines 274 and to upper end web panels 242 at transverse fold lines 256. On the other side of the blank 250, top webs 250 are foldably connected to opposite ends of the top panel 230 at longitudinal fold lines 276 and to upper end web panels 242 at transverse fold lines 256. Upper cutout apertures 252 may be struck from adjacent portions of the end webs 240 and the top webs 250. Lower cutout apertures 254 may be struck generally at each junction of the panels 210, 220, 222, 244.

Figure 5:
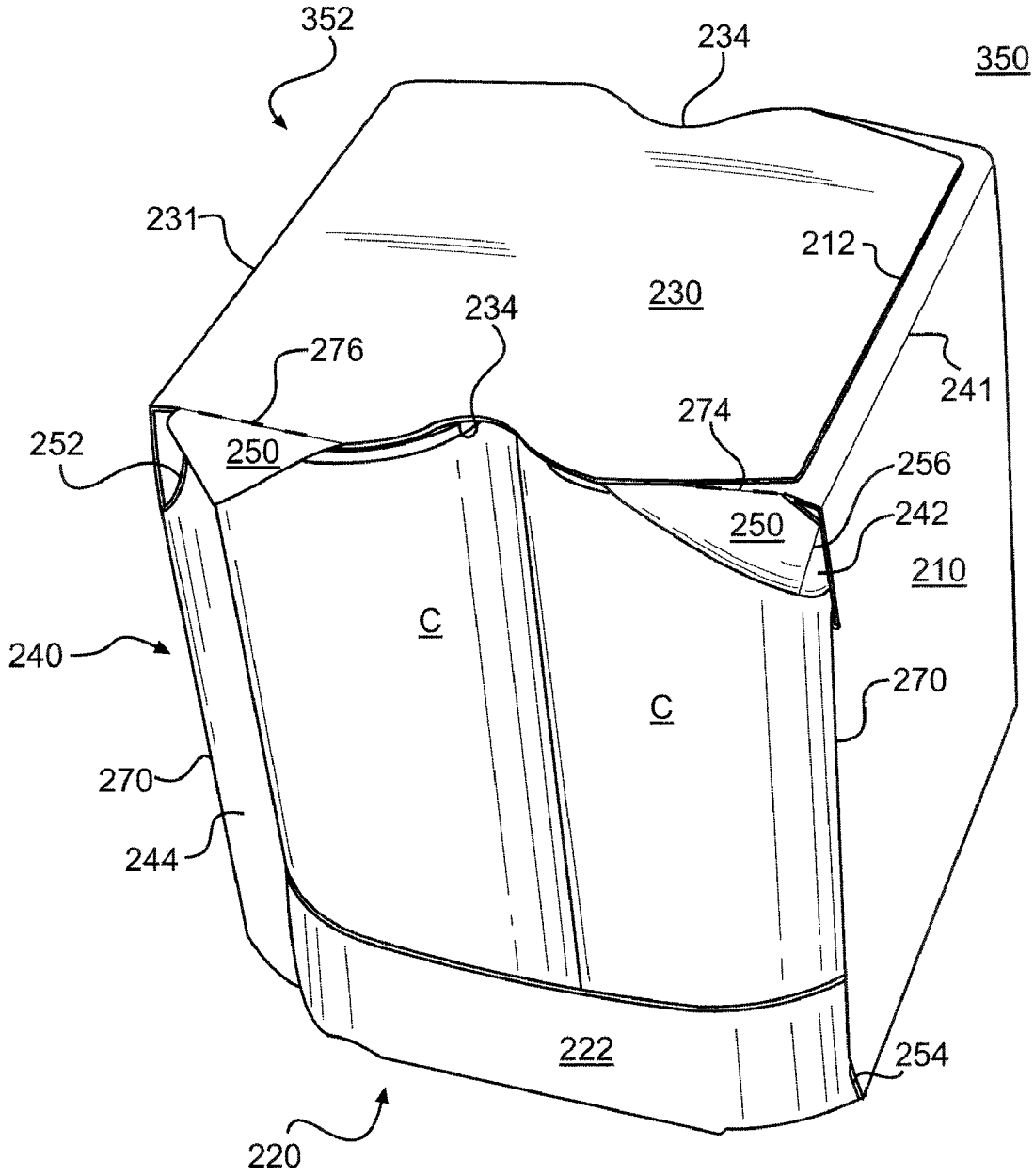
FIG. 5 illustrates the carrier package according to the second embodiment of the invention.

The top panel 230 may be formed from, for example, a generally square or rectangular shaped section of board, with one or more curved cutout sections 234 struck therefrom. The curved sections 234 can be configured, for example, so that the contour of the top panel 230 generally conforms to the cylindrical contour of containers C accommodated in the carrier package 350 (FIG. 5). The carrier blank 208 may have oblique edges 280 that extend along the end webs 240 and a portion of the bottom end panels 222. Longitudinal edges 282 of the bottom end panels 222 extend between the oblique edges 280.

The fold lines 221, 231, 241, 243, 245, 224, 256, 270, 272, 274, 276 formed in the blank 208 may be, for example, score lines, cut-space lines, cut-crease lines, overlapping and/or sequential combinations thereof, or other lines of disruption that facilitate folding of the blank 208. In the illustrated exemplary embodiment, the fold lines 221, 256, 272, 274 are crease lines and the fold lines 231, 241, 243, 245, 224, 270, 276 are cut-crease lines.

An exemplary method of erection of the carrier package 350 is discussed below with reference to FIGS. 4 and 5. In the exemplary method, the carrier blank 208 may be provided with glue or other adhesive on the print or exterior side of the adhesive panel 212. An n×m arrangement of containers C, where n and m are positive integers, is placed on the bottom panel 220. The side panels 210 of the blank 208 are folded upwardly about the transverse fold lines 221. The webs 240, 250 are folded inwardly as the side panels 210 are folded upwardly. The major end web panels 244 of the webs 240 fold inwardly about the oblique fold lines 270 so that they abut the sides of the containers C, as shown in FIG. 5. The upper end panels 242 fold with respect to the major end panels 244 at the fold lines 243, and with respect to the top web panels 250 at the fold lines 256. The bottom end panels 222 fold upwardly with respect to the bottom panel 220, and partially deform and wrap around the exteriors of the containers C.

When the side panels 210 reach a generally vertical orientation, the adhesive panel 212 is folded over about the fold line 241, and the top panel 230 is folded about the fold line 231 so that the underside of the top panel 230 contacts the adhesive on the adhesive panel 212. As shown in FIG. 5, the upper surface of the adhesive panel 212 is adhered to the underside of the top panel 230 to complete erection of the carrier package 350. The erected blank 208 forms a carrier 352 accommodating the containers C.

Referring to FIG. 5, the containers C are retained at the sides of the carrier package 350 by the side panels 210 and at their tops by the top panel 230. The end webs 240, the top webs 250, and the bottom end panels 222 serve to partially close each of the ends of the carrier package 350 to retain the containers C within the carrier package 350. The carrier package 350 can have, for example, a generally parallelepipedal shape. The bottom end panels 222 abut and retain bottom portions of the containers C at each end the carrier package 350. The top webs 250 extend obliquely across the open ends of the carrier package 350 and retain upper portions of the containers C within the carrier package 350. The upper end web panels 242 and the major end web panels 244 are tucked inwardly and press against the sides of the containers C. The major end web panels 244 are tucked inwardly between adjacent containers C and the side panels 210 so that the exterior, print side of the web panels 244 faces inwardly towards the containers C in the package 350. The upper end panels 242 are tucked between adjacent containers C and the panels 244, 210.

The bottom end panels 222, the top webs 250 and the upper end panels 242 partially deform and wrap around the exterior of the containers C to better secure the containers within the carrier package 350. The ends of the carrier package 350 can be partially open, for example, and constructed to expose a predetermined portion of the containers C.

Figure 6:
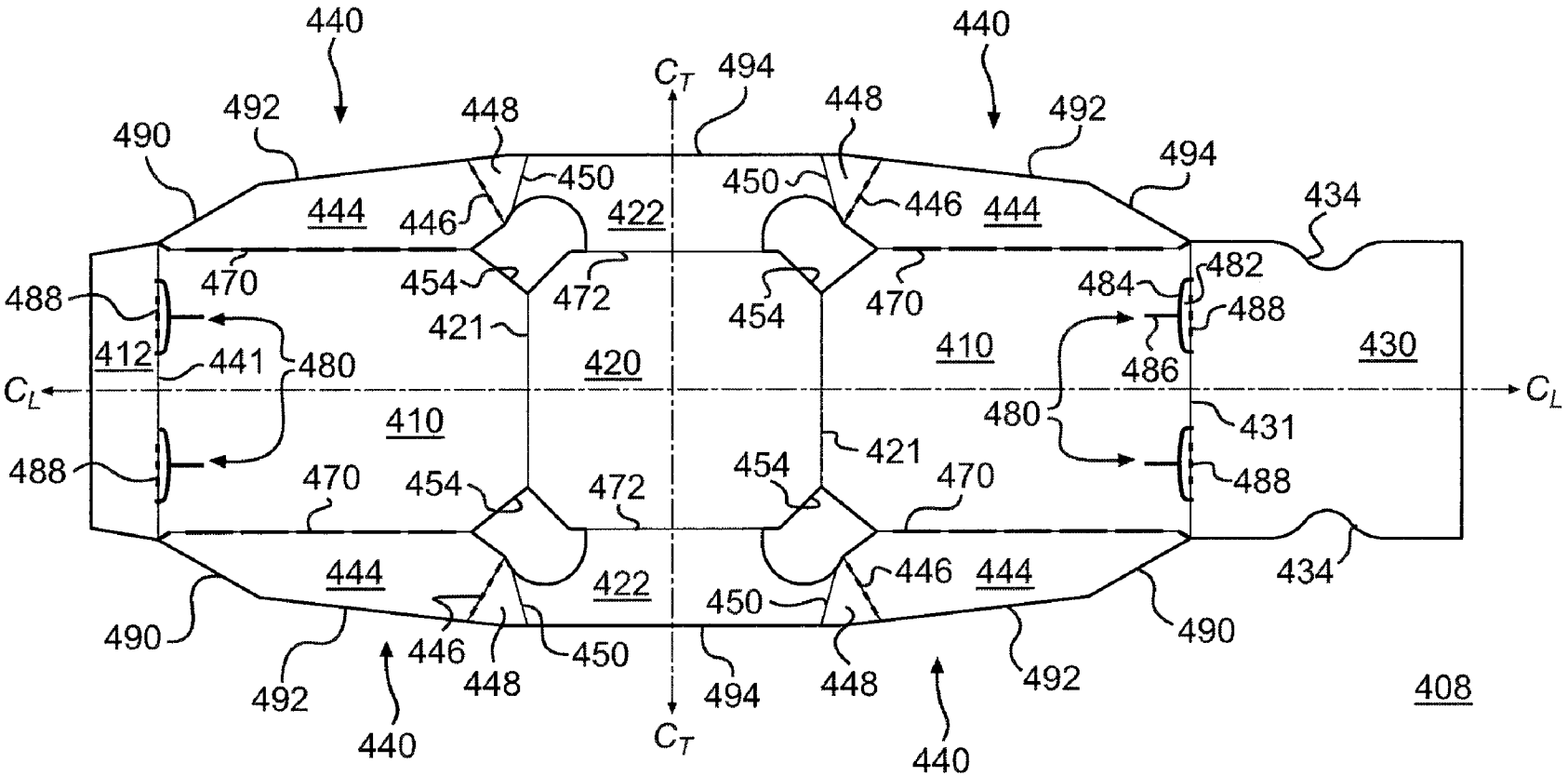
FIG. 6 is a plan view of a carrier blank used to form a carrier package according to a third embodiment of the invention.

FIG. 6 is a plan view of a first side of a carrier blank 408 used to form a carrier package or pack 550 (illustrated in FIGS. 9 and 10) according to a third embodiment of the invention. The blank 408 is shown print or exterior side up. The carrier blank 408 may be wholly or partially symmetric about a longitudinal centerline $C_L$, and partially symmetric about a transverse centerline $C_T$. Therefore, certain elements in the drawing figures share common reference numerals in order to reflect the whole and/or partial longitudinal and transverse symmetries.

The blank 408 comprises a first side panel 410 foldably connected to a first side of a bottom panel 420 at a transverse fold line 421, a second side panel 410 foldably connected to a second side of the bottom panel 420 at a transverse fold line 421, and a top panel 430 foldably connected to the second side panel 410 at a transverse fold line 431. An adhesive panel 412 may be foldably connected to the first side panel 410 at a transverse fold line 441. Alternatively, an adhesive panel (not illustrated) may be foldably connected to the top panel 430 at the opposite end of the blank 408.

According to one exemplary aspect of the present invention, end webs 440 and bottom end panels 422 serve to partially close the ends of the carrier package 550 (FIGS. 9 and 10) to partially retain containers C within the carrier package 550. Retaining sections 480 may be formed at upper edges of the first and second side panels 410 and serve to retain and secure upper portions of the containers C accommodated within the carrier package 550. A bottom end panel 422 may be foldably connected to each end of the bottom panel 420 at a longitudinally extending fold line 472 to retain lower portions of the containers C within the carrier package 550.

An end web 440 may be foldably connected to each end of the side panels 410 at a longitudinal fold line 470. Each end web 440 comprises a major end web panel 444 foldably connected to a lower end web panel 448 at an oblique fold line 446. Each lower end web panel 448 is foldably connected to one side of a bottom end panel 422 at an oblique fold line 450. Cutout apertures 454 may be struck generally at each corner of the bottom panel 420 and to extend through adjacent portions of the end webs 440, the bottom end panels 422, the side panels 410 and the bottom panel 420.

The retaining sections 480 may be formed at an upper edge of the first side panel 410 at or in the vicinity of the transverse fold line 441, and at an upper edge of the second side panel 410 at or in the vicinity of the transverse fold line 431. Each retaining section 480 may defined in part by a generally transversely extending curved perimeter cut 484 and a longitudinal cut 486 extending from the perimeter cut 484. Each perimeter cut 484 in part defines a retaining projection, such as, for example, a chime or tab 482 in an upper edge of a side panel 410. Each retaining projection 482 may be hinged and/or pivotable about a transverse fold line 488. The transverse fold lines 488 may be, for example, collinear and overlapping with respective fold lines 441, 431.

Figure 9:
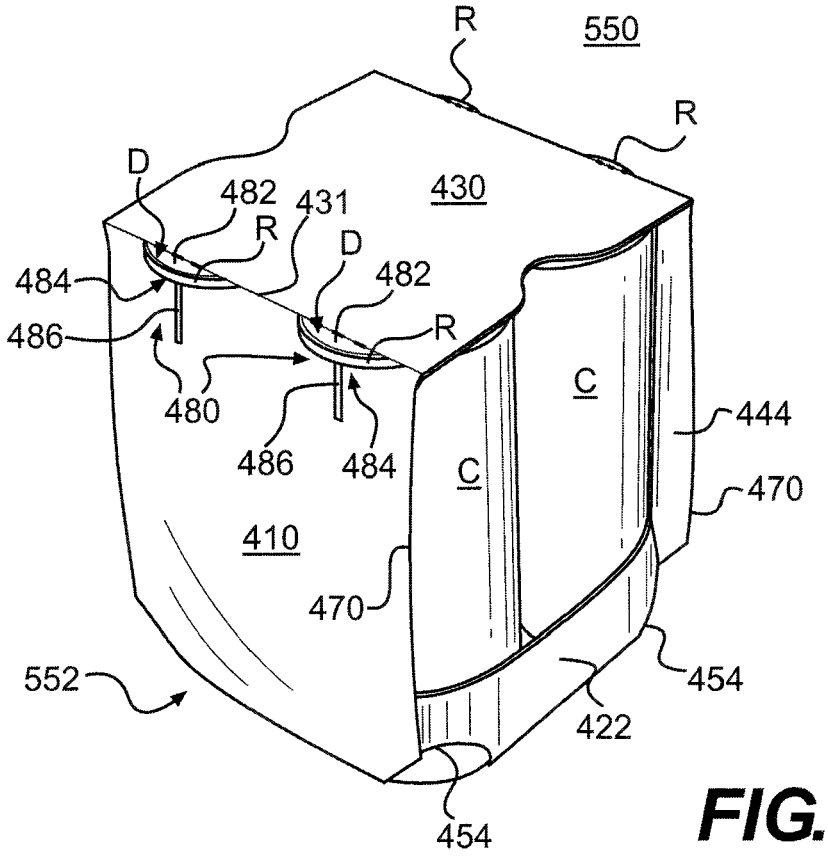
FIG. 9 illustrates the carrier package according to the third embodiment of the invention.
Figure 10:
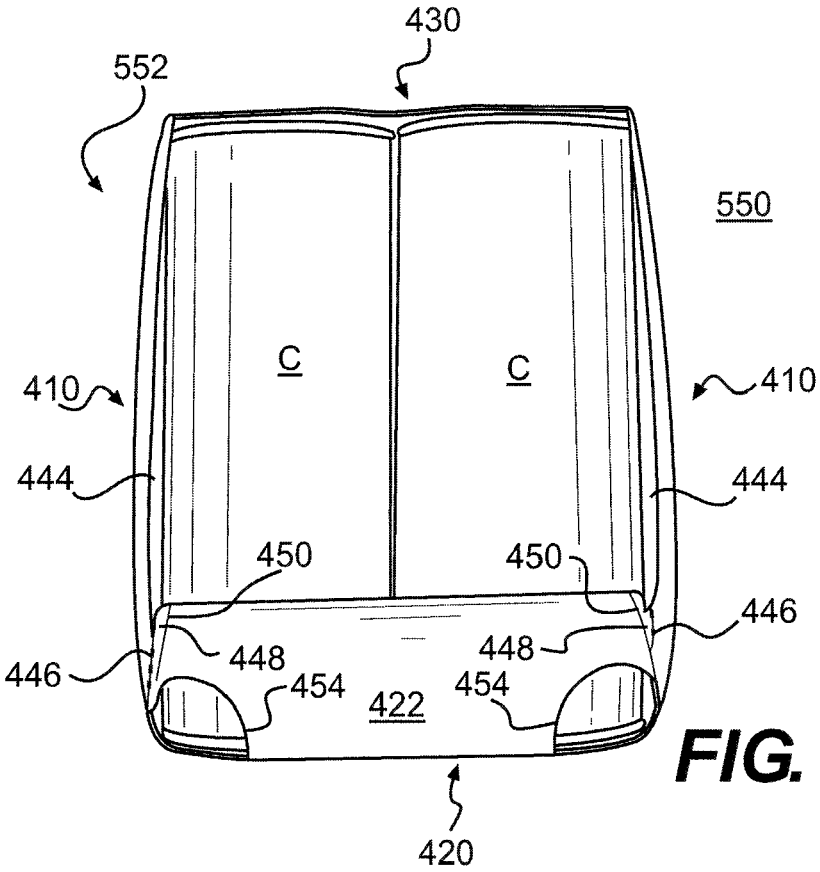
FIG. 10 illustrates is an end view of the third carrier package embodiment.

The top panel 430 may be formed from, for example, a generally square or rectangular shaped section of board, with one or more curved cutout sections 434 struck therefrom. The curved cutout sections 434 can be configured, for example, so that the contour of the top panel 430 generally conforms to the generally cylindrical contour of the containers C accommodated in the carrier package 550 (FIGS. 9 and 10).

The fold lines 421, 431, 441, 446, 450, 470, 472, 488 formed in the blank 408 may be, for example, score lines, cut-space lines, cut-crease lines, overlapping and/or sequential combinations thereof, or other lines of disruption that facilitate folding of the blank 408. In the illustrated exemplary embodiment, the fold lines 421, 431, 441, 450, 472 are crease lines and the fold lines 446, 470, 488 are cut-crease lines.

Figure 7:
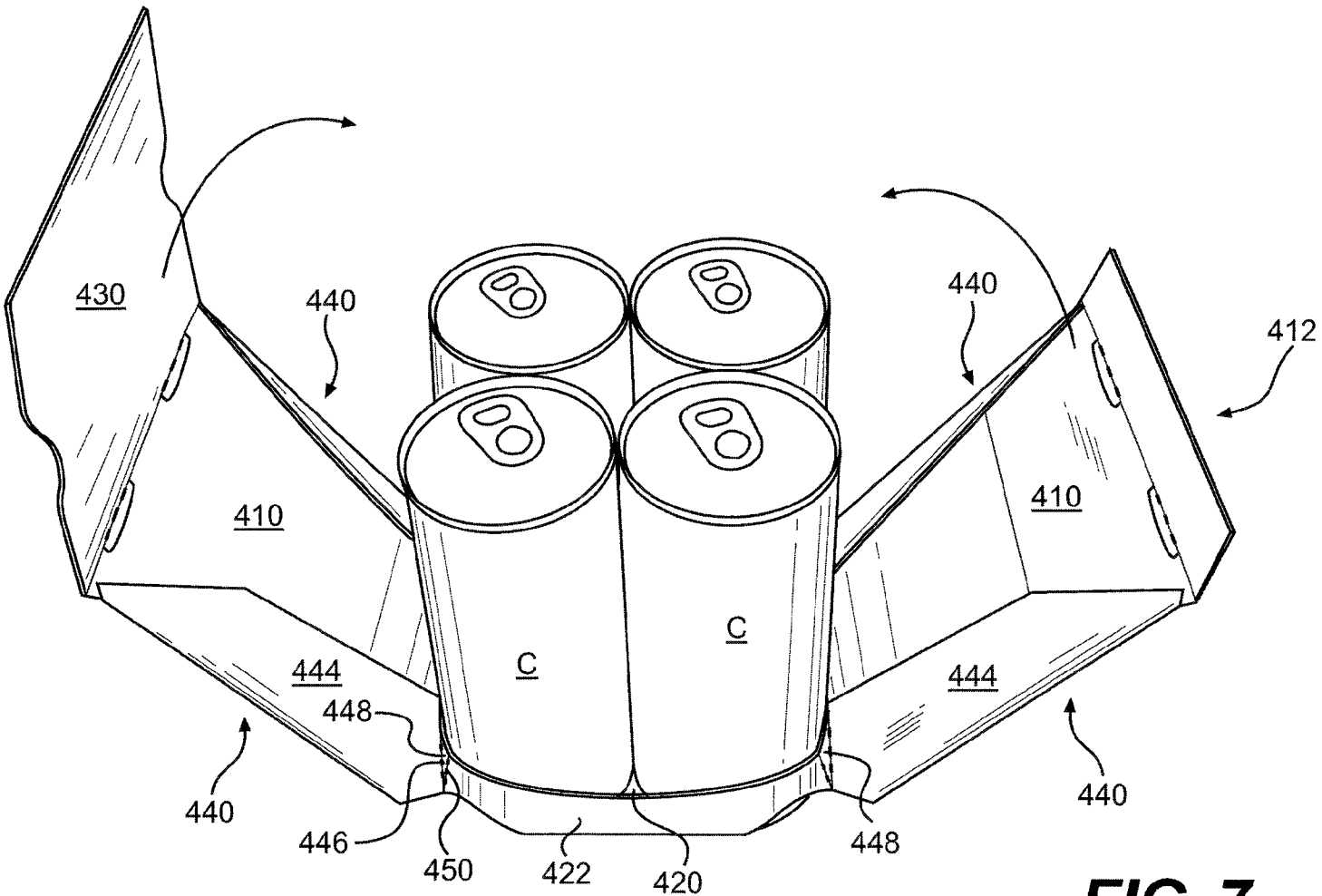
FIGS. 7 and 8 illustrate erection steps of the third carrier package embodiment.

An exemplary method of erection of the carrier package 550 is discussed below with reference to FIGS. 6-9. Referring to FIG. 6, the carrier blank 408 may be provided with glue or other adhesives at on the adhesive panel 412. Referring to FIG. 7, the carrier package 550 may be erected by placing an n×m arrangement of containers on the bottom panel 420. In the exemplary embodiment, the containers C are arranged in a 2×2 configuration. The side panels 410 of the blank 408 are folded upwardly in the direction of the curved arrows about the transverse fold lines 421. The end and top webs 440, 450 are folded inwardly as the side panels 410 are folded upwardly, causing the bottom end panels 422 to fold upwardly with respect to the bottom panel 420 and to abut the sides of adjacent containers C. The bottom end panels 422 partially deform and wrap around the exterior lower contours of the containers C. The lower end panels 448 fold or tuck inwardly with respect to the major end panels 444 at the fold lines 446, and with respect to the bottom end panels 422 at the fold lines 450 so that the panels 448 abut the sides of adjacent containers C.

Figure 8:
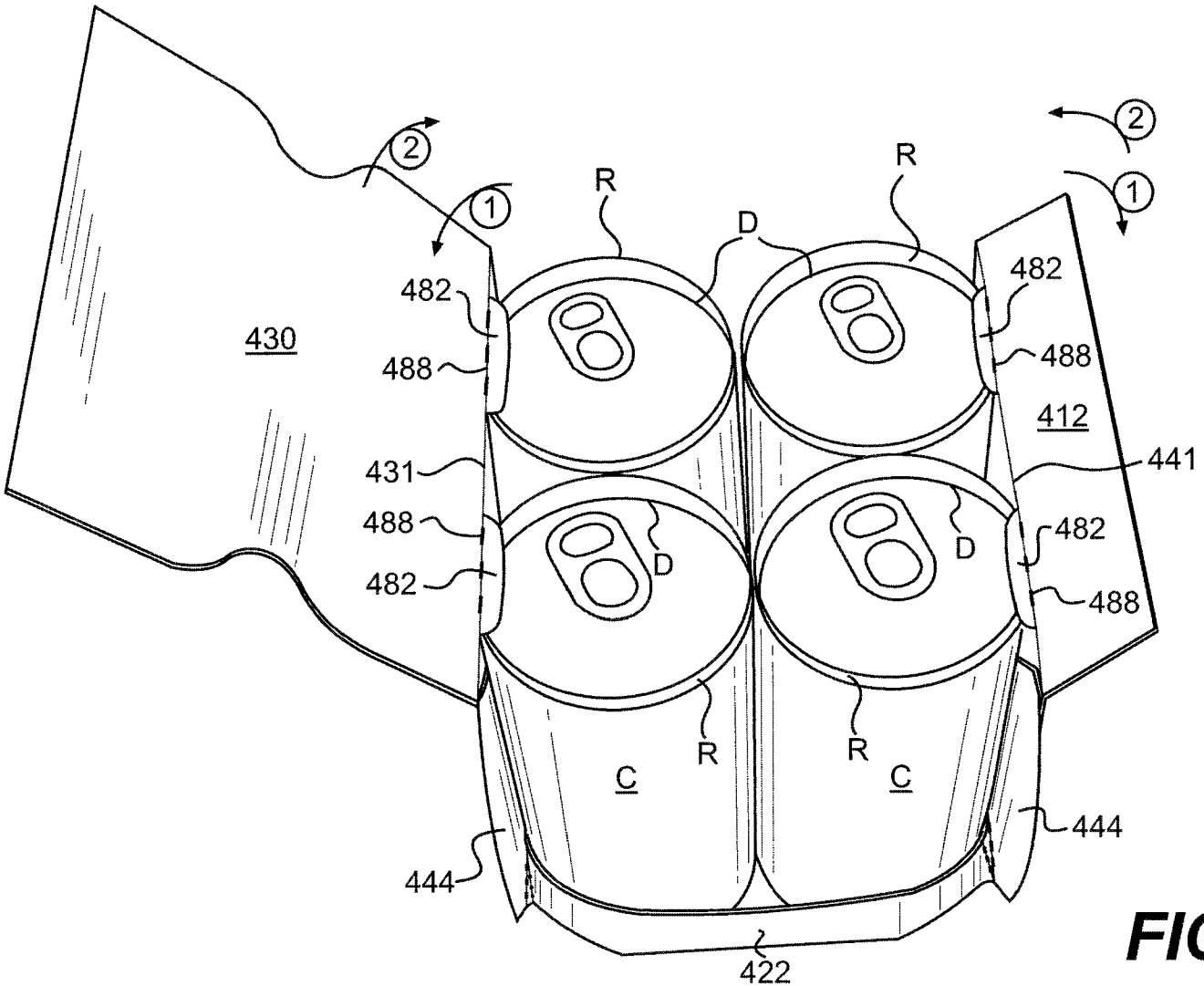

Referring to FIG. 8, when the side panels 410 reach a vertical orientation, the top panel 430 and the adhesive panel 412 are folded back about the fold lines 431, 441, respectively, in the direction of the arrows 1. The projections 482 are thereby extended into cylindrical depressions D at the upper rims R of the generally cylindrical containers C. The adhesive panel 412 is then folded inwardly about the fold line 441, and the top panel 430 is folded over the adhesive panel 412, in the direction of the arrows 2. Folding the panels 212, 430 inwardly causes the underside of the top panel 430 to contact the adhesive on the upper surface of the adhesive panel 412.

FIGS. 9 and 10 illustrate the erected and loaded carrier package 550. The erected blank 408 forms a carrier 552 accommodating the n×m arrangement of containers C to form the package 550. The containers C are retained at the sides of the carrier package 550 by the side panels 410, and at their tops by the top panel 430. The end webs 440 and the bottom end panels 422 serve to partially close the ends of the carrier package 550 to prevent the containers C from falling out of the partially open ends of the package 550. As shown in FIG. 9, the retaining projections 482 are pressed into the depressions D and secure the upper rim sections R of the containers C within the carrier package 550. Referring also to FIG. 10, the bottom end panels 422 retain bottom portions of the containers C within the carrier package 550. The major end web panels 444 and the bottom end web panels 448 are tucked inwardly, between adjacent containers C and the side panels 410, and partially deform and wrap around the sides of the containers C. The ends of the carrier package 550 can be, for example, partially open and constructed to expose a predetermined portion of the containers C.

In the above embodiments, the exemplary carrier packages 150, 350, 550 are shown as accommodating generally cylindrical beverage can containers. Other types of articles, however, can be accommodated within carrier packages according to principles of the present invention. The dimensions of the carrier blanks 8, 208, 408 may also be altered, for example, to accommodate various article forms and sizes.

Varying numbers of columns and rows of articles such as containers C can be accommodated in carrier packages constructed according to the principles of the present invention. For example, the top panel 30 and the bottom panel 20 can be lengthened along the longitudinal direction of the blank 8 (measured from left to right in FIG. 1) in order to accommodate additional rows of containers C. In one such embodiment, a carrier may be constructed that accommodates six containers arranged in, for example, three rows and two columns (3×2) or two rows and three columns (2×3). In general, any n×m (where n and m are positive integers) arrangement of articles can be accommodated within carrier packages according to the present invention.

In the illustrated embodiments, cutout sections struck from the blank may alternatively be formed from knockout sections that are removed, for example, before or during erection of the blanks.

In accordance with the exemplary embodiments, the blanks may be constructed of paperboard of a caliper such that it is heavier and more rigid than ordinary paper. The blanks can also be constructed of other materials, such as cardboard or any other material having properties suitable for enabling the carrier package to function at least generally as described above. The blanks can also be laminated to or coated with one or more sheet-like materials at selected panels or panel sections.

The blanks can be laminated to or coated with one or more sheet-like materials at selected panels or panel sections. Interior and/or exterior sides of the blanks can be coated with a clay coating. The clay coating may then be printed over with product, advertising, price coding, and other information or images. The blanks may then be coated with a varnish to protect information printed on the blank. The blanks may also be coated with, for example, a moisture barrier layer, on either or both sides of the blanks.

The above embodiments may be described as having one or panels adhered together by glue. The term "glue" is intended to encompass all manner of adhesives and other means commonly used to secure panels and flaps.

For purposes of the description presented herein, the term "line of disruption" or "line of weakening" can be used to generally refer to a cut line, a score line, a tear line, a crease line, perforations (e.g., a series of spaced cuts), a fold line, or other disruptions formed in a blank, and overlapping and/or sequential combinations thereof.

In accordance with the exemplary embodiment of the present invention, a fold line can be any substantially linear, although not necessarily straight, form of disruption or weakening in a blank that facilitates folding, pivoting or bending therealong. More specifically, but not for the purpose of narrowing the scope of the present invention, examples of fold lines include: score lines; crease lines; a cut or a series of cuts that extend partially into and/or completely through the material along a desired line of weakness; and various overlapping and/or sequential combinations of these features.

In the present specification, a "panel" or "flap" need not be flat or otherwise planar. A "panel" or "flap" can, for example, comprise a plurality of interconnected generally flat or planar blank sections.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carrier package blank for forming a carrier package holding a plurality of containers, comprising:

a bottom panel for supporting bottoms of containers in the carrier package formed from the carrier package blank;

a first side panel foldably connected to the bottom panel;

a second side panel foldably connected to the bottom panel;

a top panel;

an adhesive panel;

a first bottom end panel foldably connected to a first end of the bottom panel;

a second bottom end panel foldably connected to a second end of the bottom panel;

a first end web foldably connected to the first bottom end panel and the first side panel; and a second end web foldably connected to the first bottom end panel and the second side panel, the first end web and the second end web being at a first end of the blank, wherein each of the first end web and the second end web comprises a major end web panel respectively foldably connected to one of the first side panel and the second side panel, an upper end web panel foldably connected to the respective major end web panel, and a top web foldably connected to the respective upper end web panel and at least one of the top panel and the adhesive panel.

2. The blank of claim 1, wherein the top web is foldably connected to the upper end web panel at a transverse fold line.

3. The blank of claim 1, wherein the upper end web panel is foldably connected to the major end web panel of the first end web at an oblique fold line.

4. The blank of claim 1, wherein the first end web further comprises a lower end web panel foldably connected to a lower edge of the major end web panel of the first end web.

5. The blank of claim 4, wherein the lower end web panel is foldably connected to the major end web panel of the first end web at an oblique fold line.

6. The blank of claim 1, further comprising at least four lower cutout apertures, at least one cutout aperture being struck at least from each end web.

7. The blank of claim 1, wherein the first end web further comprises a lower end web panel foldably connected to a lower edge of the major end web panel of the first end web.

8. The blank of claim 7, wherein the lower end web panel is foldably connected to the lower edge of the major end web panel of the first end web at an oblique fold line.

9. The blank of claim 6, further comprising a plurality of upper cutout apertures, one cutout aperture being struck at least from each end web.

10. The blank of claim 1, further comprising a plurality of retaining sections comprising at least one first retaining section formed at least partially in at the first side panel and at least partially defined by a first transverse fold line connecting the top panel to the first side panel.

11. The blank of claim 10, wherein each retaining section comprises a retaining projection defined at least in part by a perimeter cut in one of the side panels.

12. The blank of claim 1, wherein the blank is constructed from paperboard.

13. A carrier package for holding a plurality of containers, comprising:

a carrier formed from a blank having an exterior side and an interior side, the carrier comprising:

a bottom panel for supporting bottoms of the containers;

a first side panel foldably connected to the bottom panel;

a second side panel foldably connected to the bottom panel;

a top panel and an adhesive panel at least partially affixed to the top panel;

a bottom end panel foldably connected to a first end of the bottom panel;

a first end web foldably connected to the bottom end panel and the first side panel; and a second end web foldably connected to the bottom end panel and the second side panel, the first end web and the second end web being at a first end of the carrier, wherein each of the first and second end webs comprises a major end web panel respectively foldably connected to one of the first and second side panels, an upper end web panel foldably connected to the respective major end web panel, and a top web foldably connected to the respective upper end web panel and at least one of the top panel and the adhesive panel; and a plurality of containers accommodated in the carrier, wherein an exterior side of at least a portion of the first end web and the second end web is tucked inwardly in the carrier and is adjacent to at least one of the articles.

14. The carrier package of claim 13, wherein an exterior side of each of the major end web panels is tucked inwardly in the carrier and is adjacent to at least one of the containers.

15. The carrier package of claim 14, wherein each upper end web panel is tucked between an adjacent container and the first side panel.

16. The carrier package of claim 15, the top web having an interior side facing an adjacent container.

17. The carrier package of claim 15, wherein each end web further comprises a lower end web panel foldably connected to the respective major end web panel and tucked between an adjacent container and an adjacent side panel.

18. The carrier package of claim 17, wherein the lower end web panel is foldably connected to a lower edge of the respective major end web panel.

19. The carrier package of claim 14, wherein the each end web respectively further comprises a lower end web panel foldably connected to a lower edge of the respective major end web panel.

20. The carrier package of claim 19, wherein each lower end web panel is tucked between an adjacent container and a respective one of the first side panel and the second side panel.

21. The carrier package of claim 20, wherein each top web is foldably connected to an edge of a respective one of the upper end web panels and has an interior side facing an adjacent container.

22. The carrier package of claim 13, further comprising at least four lower cutout apertures, at least one lower cutout aperture being struck at least from each end web.

23. The carrier package of claim 22, further comprising a plurality of upper cutout apertures, at least one upper cutout aperture being struck at least from each end web.

24. The carrier package of claim 13, further comprising a plurality of retaining sections comprising at least one first retaining section being formed at least partially in the first side panel and at least partially defined by a first transverse fold line connecting the top panel to the first side panel.

25. The carrier package of claim 24, wherein each retaining section comprises a retaining projection defined at least in part by a perimeter cut in one of the side panels.

26. The carrier package of claim 25, wherein each retaining projection extends into a depression in a top surface of a respective one of the containers.

27. The carrier package of claim 13, further comprising a first bottom end panel foldably connected to a first end of the bottom panel and a second bottom end panel foldably connected to a second end of the bottom panel.

28. The carrier package of claim 27, wherein the first bottom end panel is foldably connected at one side to the first end web and foldably connected at a second side to the second end web.

29. A method of erecting a carrier package for holding a plurality of containers, comprising:

obtaining a carrier package blank comprising:

a bottom panel;

a first side panel foldably connected to the bottom panel;

a second side panel foldably connected to the bottom panel;

a top panel;

an adhesive panel;

a bottom end panel foldably connected to a first end of the bottom panel;

a first end web foldably connected to the bottom end panel and the first side panel; and a second end web foldably connected to the first bottom end panel and the second side panel, the first end web and the second end web being at a first end of the blank, wherein each of the first end web and the second end web comprises a major end web panel respectively foldably connected to one of the first side panel and the second side panel, an upper end web panel foldably connected to the respective major end web panel, and a top web foldably connected to the respective upper end web panel and at least one of the top panel and the adhesive panel;

placing a plurality of containers on the blank so that bottoms of the containers are supported by the bottom panel;

folding the first and second side panels with respect to the bottom panel;

folding the top panel so that it extends generally perpendicular with respect to the side panels; and tucking the first end web and the second end web inwardly so that an exterior side of at least a portion of each end web is adjacent to at least one of the containers.

30. The method of claim 29, wherein tucking the first and second end webs inwardly tucks an exterior side of the respective major end web panel inwardly and adjacent to at least one of the containers.

31. The method of claim 30, wherein the bottom end panel is a first bottom end panel and the blank further comprises a second bottom end panel foldably connected to a second end of the bottom panel.

32. The method of claim 31, further comprising pivoting the first bottom end panel upwardly as the first and second side panels are folded with respect to the bottom panel.

33. The method of claim 30, wherein the blank further comprises a plurality of retaining sections comprising at least one first retaining section being formed at least partially in the first side panel and at least partially defined by a first transverse fold line connecting the top panel to the first side panel, the method further comprising inserting each retaining section in a depression in a top surface of a respective one of the containers.

34. The method of claim 33, further comprising:

bending the top panel with respect to the first side panel about the first transverse fold line in a first direction before inserting the retaining sections in the depressions; and bending the top panel with respect to the first side panel about the first transverse fold line in a second direction after inserting the retaining sections in the depressions.

35. The method of claim 29, wherein the containers are generally cylindrical containers.

36. The carrier package of claim 13 wherein the bottom end panel extends between the first side panel and the second side panel and contacts bottom portions of the containers to restrain the containers in the carrier package.

37. The blank of claim 10, wherein the plurality of retaining sections further comprises at least one second retaining section at least partially formed in the second side panel and at least partially defined by a second transverse fold line connecting the adhesive panel to the second side panel.

38. The carrier of claim 24, wherein the plurality of retaining sections further comprises at least one second retaining section at least partially formed in the second side panel and at least partially defined by a second transverse fold line connecting the adhesive panel to the second side panel.

39. The method of claim 33, wherein the plurality of retaining sections further comprises at least one second retaining section at least partially formed in the second side panel and at least partially defined by a second transverse fold line connecting the adhesive panel to the second side panel.

* * * * *